US005423430A

United States Patent [19]

Zaffiro et al.

[11] Patent Number: 5,423,430

[45] Date of Patent: Jun. 13, 1995

[54] "MEGA BUCKS" ROCKER BUCKET GOLD RECOVERY SYSTEM

[76] Inventors: Jerry Zaffiro, 830 N. Grant Ave., Lodi, Calif. 95240; William H. Farren, 156 "E" St., Galt, Calif. 95632

[21] Appl. No.: 231,923

[22] Filed: Apr. 25, 1994

[51] Int. Cl.[6] ..... B07B 1/06

[52] U.S. Cl. ..... 209/315; 209/403; 209/417

[58] Field of Search ..... 209/325, 417, 403, 399

[56] References Cited

U.S. PATENT DOCUMENTS

| | | | |
|---|---|---|---|
| 222,265 | 12/1879 | Ford | 209/417 |
| 618,918 | 2/1899 | Stoodley | 209/399 |
| 1,030,673 | 6/1912 | McIlvaine | 209/403 |
| 1,350,080 | 8/1920 | Notter | 209/417 |
| 2,679,935 | 8/1950 | Manchan | 209/417 |
| 3,315,807 | 9/1964 | Rosen | 209/315 |
| 3,776,382 | 12/1973 | Wright et al. | 209/403 |
| 5,190,158 | 3/1993 | Remias | 209/417 |

*Primary Examiner*—Andres Kashnikow
*Assistant Examiner*—Lisa Douglas

[57] ABSTRACT

A rocker bucket gold recovery system comprising a container having a plurality holes disposed thereon for drainage; a rocker coupled to the container for rocking the container; a plurality of classifying screens; and separating mechanism for separating the classifying screens when disposed within the container, thus creating a configuration adapted for effecting a separation of materials poured into the container into portions composed of essentially equivalent sized particles.

2 Claims, 4 Drawing Sheets

"MEGA BUCKS" ROCKER BUCKET GOLD RECOVERY SYSTEM

BACKGROUND OF THE INVENTION

1. Field of the Invention

The present invention relates to a rocker bucket gold recovery system and more particularly pertains to recovering gold from gold-bearing gravel with a rocker bucket gold recovery system.

2. Description of the Prior Art

The use of gold recovery devices is known in the prior art. More specifically, gold recovery devices heretofore devised and utilized for the purpose of recovering gold are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,855,119 to Stephenson discloses a gold pan. U.S. Pat. No. 4,289,241 to Litrap discloses a gold pan and classifier. U.S. Pat. No. 4,319,994 to Morgan discloses a gold mining pan. U.S. Pat. No. 4,400,269 to Gordon, Jr. discloses a gold pan. U.S. Pat. No. 4,671,868 to Ottrok discloses a method for recovering gold, platinum, or silver from an ore containing gold dust, platinum dust, or silver dust.

While these devices fulfill their respective, particular objective and requirements, the aforementioned patents do not describe a rocker bucket gold recovery system that is designed to be easily reconfigurable and transportable and includes an integral rocker coupled thereto for effecting a rocking motion to the bucket.

In this respect, the rocker bucket gold recovery system according to the present invention substantially departs from the conventional concepts and designs of the prior art, and in doing so provides an apparatus primarily developed for the purpose of recovering gold from gold-bearing gravel.

Therefore, it can be appreciated that there exists a continuing need for new and improved rocker bucket gold recovery system which can be used for recovering gold from gold-bearing gravel. In this regard, the present invention substantially fulfills this need.

SUMMARY OF THE INVENTION

In the view of the foregoing disadvantages inherent in the known types of gold recovery devices now present in the prior art, the present invention provides an improved rocker bucket gold recovery system. As such, the general purpose of the present invention, which will be described subsequently in greater detail, is to provide a new and improved rocker bucket gold recovery system and method which has all the advantages of the prior art and none of the disadvantages.

To attain this, the present invention essentially comprises, in combination, a bucket having a plurality of radially extending holes disposed on the bottom thereof for drainage; a rocker coupled to the bottom of the bucket for rocking the bucket back and forth when a jigging force is applied thereto; and a plurality of classifying screens disposed within the bucket in a tiered configuration adapted for effecting a separation of gold-bearing gravel poured into the bucket into portions composed of essentially equivalent sized particles, each classifying screen comprising an upper annular frame, a lower annular frame, and a mesh coupled therebetween, a handle coupled to the upper annular frame adapted for allowing the screen to be lifted by hand and adapted for supporting another screen disposed thereover, and a pair of diametrically opposed legs extending downwardly from the lower annular frame adapted for supporting the screen and defining a space therebetween adapted for holding separated portions of gravel collected by another screen disposed thereunder.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved rocker bucket gold recovery system which has all the advantages of the prior art gold recovery devices and none of the disadvantages.

It is another object of the present invention to provide a new and improved rocker bucket gold recovery system which may be easily and efficiently manufactured and marketed.

It is a further object of the present invention to provide a new and improved rocker bucket gold recovery system which is of durable and reliable construction.

An even further object of the present invention is to provide a new and improved rocker bucket gold recovery system which is susceptible of a low cost of manufacture with regard to both materials and labor, and which accordingly is then susceptible of low prices of sale to the consuming public, thereby making such a rocker bucket gold recovery system economically available to the buying public.

Still yet another object of the present invention is to provide a new and improved rocker bucket gold recovery system which provides in the apparatuses and methods of the prior art some of the advantages thereof, while simultaneously overcoming some of the disadvantages normally associated therewith.

Even still another object of the present invention is to provide a new and improved rocker bucket gold recovery system for recovering gold from gold-bearing gravel.

Lastly, it is an object of the present invention to provide a new and improved rocker bucket gold recovery system comprising a container having a plurality holes disposed thereon for drainage; a rocker coupled to the container for rocking the container; a plurality of classifying screens; and separating means for separating the classifying screens when disposed within the container, thus creating a configuration adapted for effecting a separation of materials poured into the container into portions composed of essentially equivalent sized particles.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
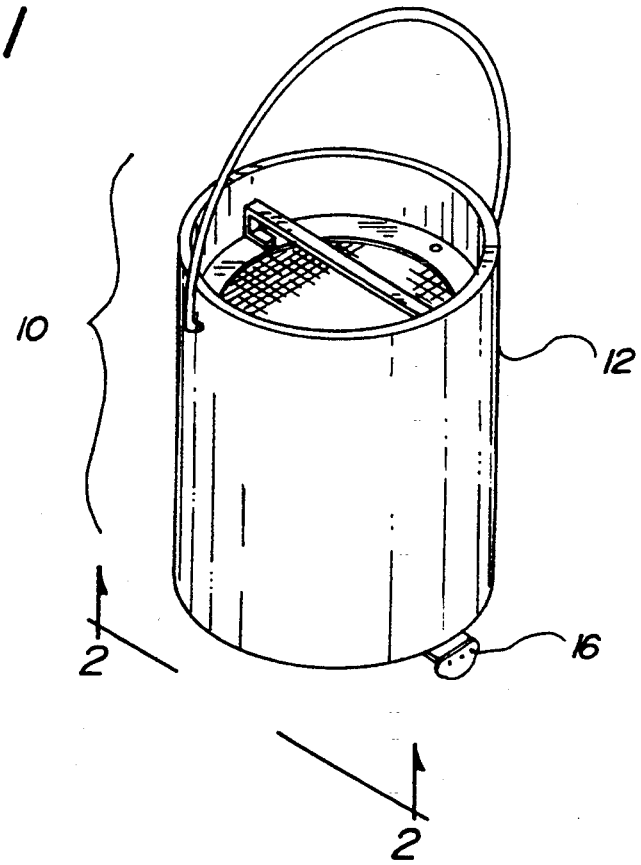
FIG. 1 is a perspective view of the preferred embodiment of the rocker bucket gold recovery system constructed in accordance with the principles of the present invention.
Figure 2:
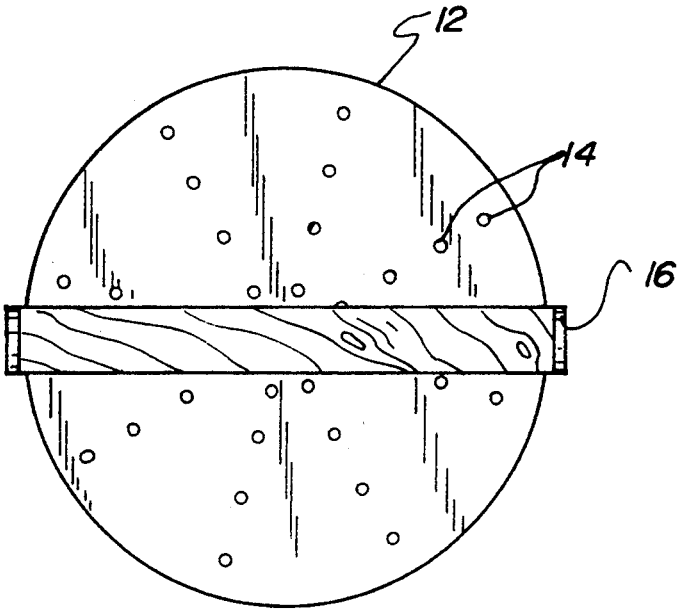
FIG. 2 is a view of the bottom of the bucket taken along the line 2—2 of FIG. 1.
Figure 3:
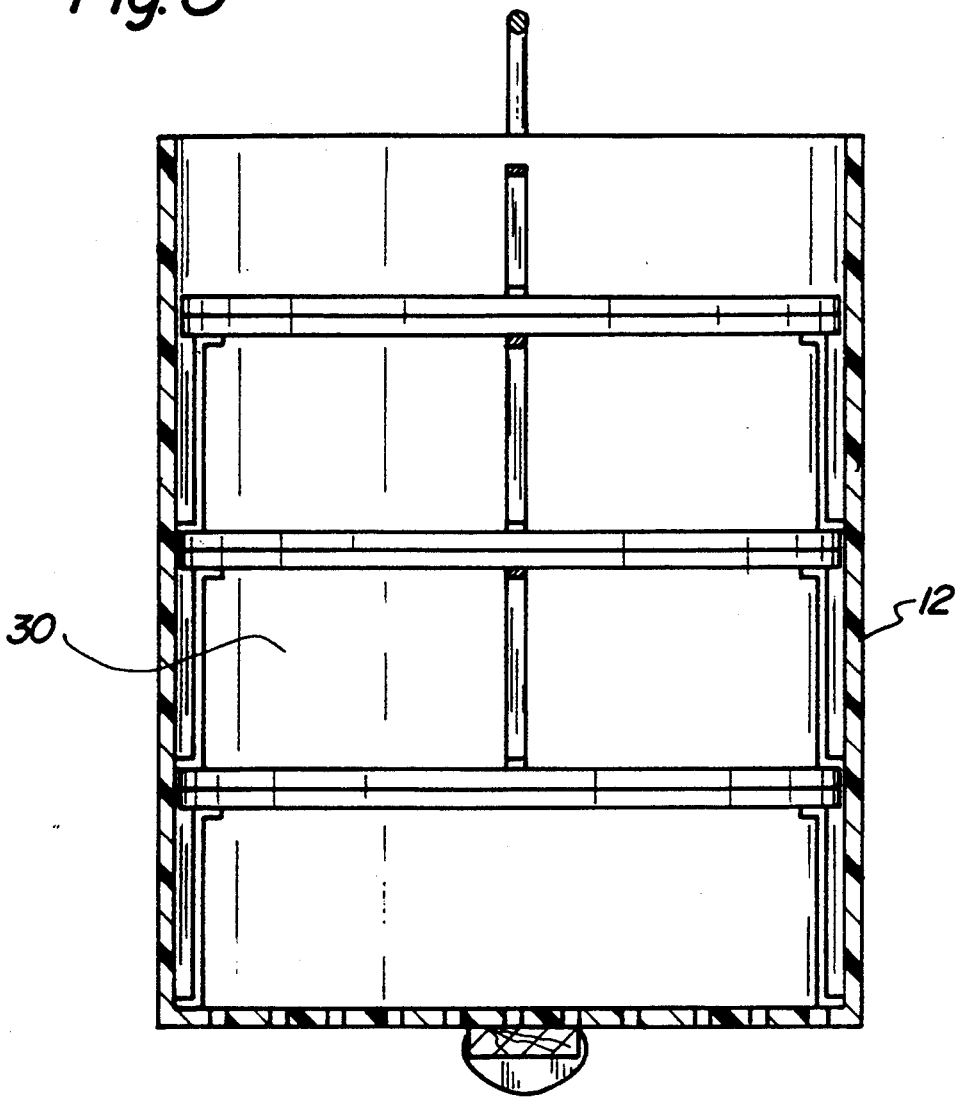
FIG. 3 is a cross-sectional view of the present invention depicting the tiered configuration of screens.
Figure 4:
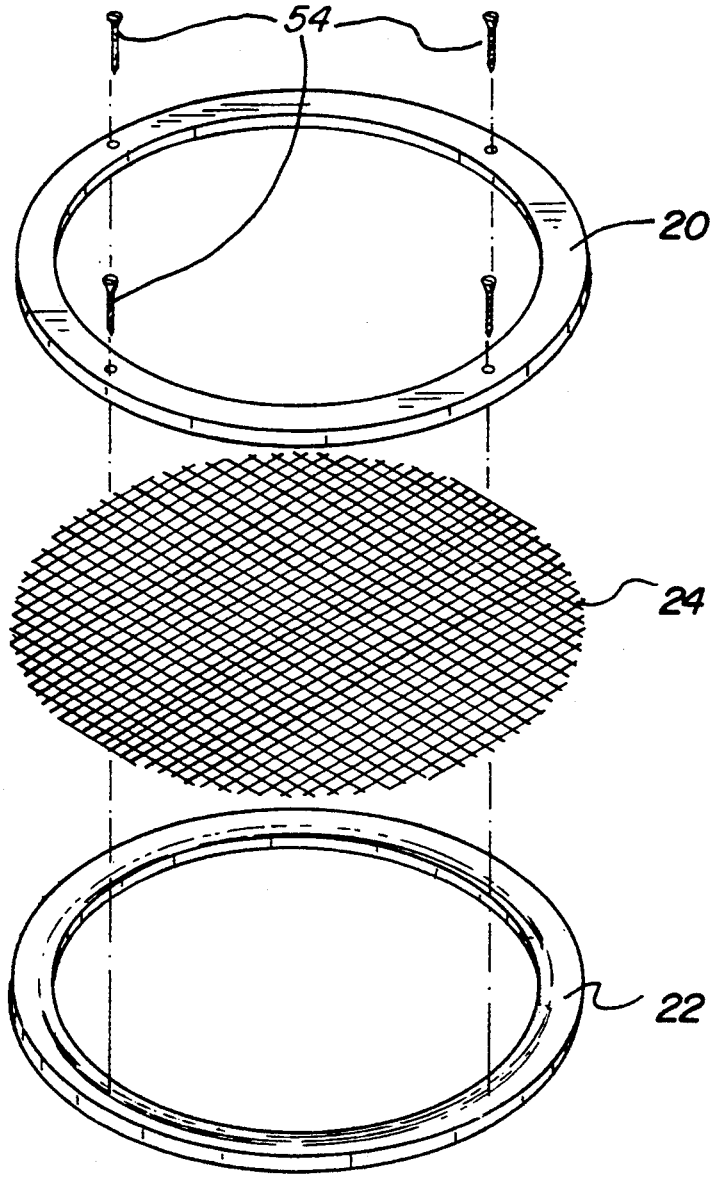
FIG. 4 is an exploded view of a screen of the present invention.
Figure 5:
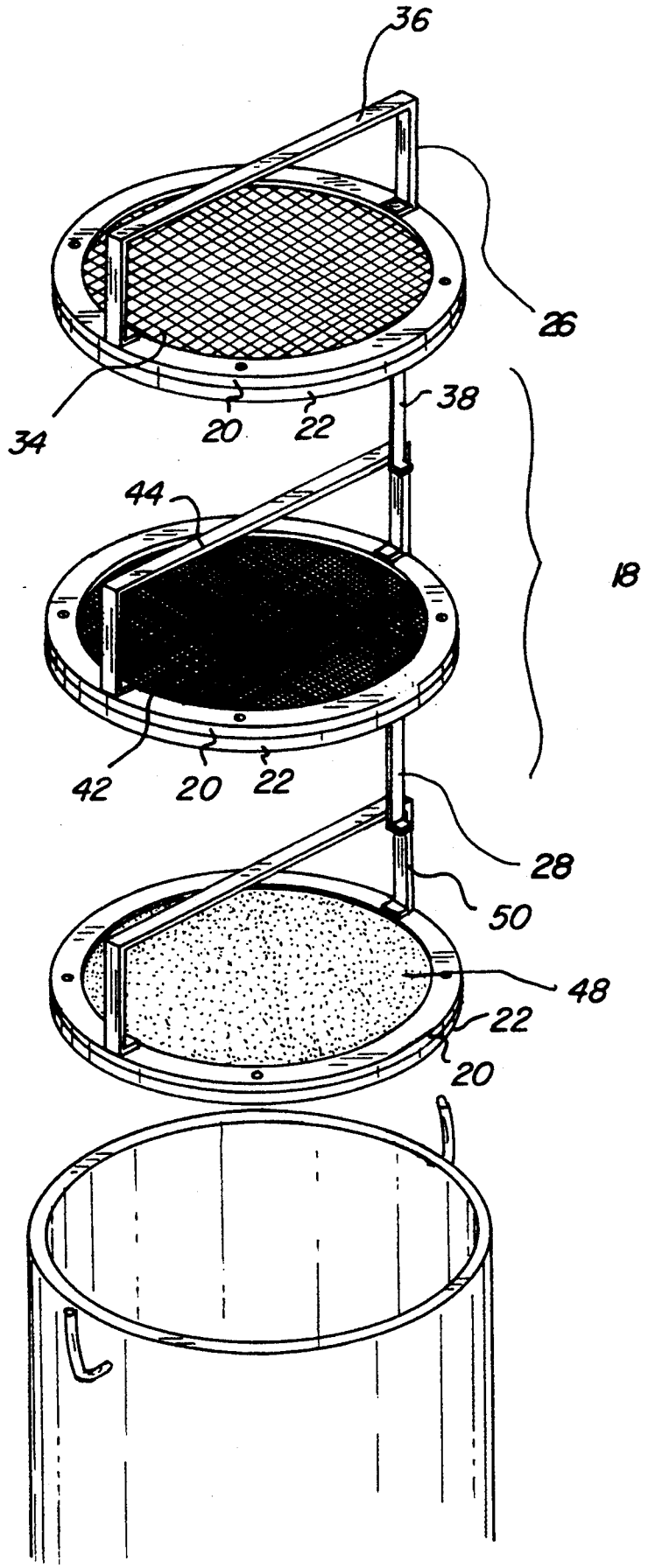
FIG. 5 is a perspective view of the present invention depicting the tiered configuration of screens for deposition within the bucket.

With reference now to the drawings, and in particular, to FIG. 1 thereof, the preferred embodiment of the new and improved rocker bucket gold recovery system embodying the principles and concepts of the present invention and generally designated by the reference number 10 will be described.

Specifically, the present invention includes three major components. The major components are the bucket, rocker, and classifying screens. These components are interrelated to provide the intended function.

More specifically, it will be noted in the various Figures that the first major component is the bucket 12. The bucket is conventional in design with a deep, curved sidewall, a flat bottom, and a curved handle. The bucket has a plurality of radially extending holes disposed on the bottom thereof. These holes are used for draining the bucket.

The second major component is the rocker 16. The rocker is rocker coupled to the bottom of the bucket 12. It is utilized for rocking the bucket back and forth when a jigging force is applied thereto. The rocker has two ends with each end formed in in cam-shaped configuration. The two ends are diametrically located at the bottom of the bucket. A rigid plank is extended between the two ends.

The third major component is the classifying screens 18. A plurality of classifying screens are disposed within the bucket in a tiered configuration. The classifying screens are adapted for effecting a separation of gold-bearing gravel poured into the bucket into portions composed of essentially equivalent sized particles.

Each classifying screen includes an upper annular frame 20, a lower annular frame 22, and a mesh 24 coupled therebetween. Each classifying screen includes a handle 26. The handle 26 is coupled to the upper annular frame. The handle performs two functions. First, the handle is adapted for allowing the screen to be lifted by hand. Second, the handle is adapted for supporting another screen disposed thereover to define a tiered configuration.

Furthermore, each classifying screen also includes a pair of diametrically opposed legs 28. The legs extend downward from the lower annular frame 22. The legs perform two functions. First, they are adapted for supporting the classifying screen. Second, the legs define a space therebetween adapted for holding separated portions of gravel collected by another classifying screen disposed thereunder.

The present invention is designed for use by people who spend some of their weekend time trying to find gold in river gravel. The present invention is designed to be effective in recovering from 80% to 85% of the gold present in gravel which is processed therein. The present invention is designed to remove the particle concentrates, with the remainder of the concentrates to be collected and fine panned later to recover the "pin head" and "flour gold".

In the preferred embodiment, a five-gallon plastic bucket is utilized. The plurality of holes on the bucket are about 9/32 inches wide and spaced about 1 inch apart in an eight-pointed star configuration extending from the center of the bucket's bottom. The annular frame of each screen is be made of metal, wood, plastic, or any other rigid material. The annular frame is about $10\frac{7}{8}$ inches in diameter and about $\frac{7}{8}$ inches wide. The upper extent of each screen's handle is projected about five inches away from the annular frame. The handles are removable. Three tiers of screens are utilized, each with progressively smaller sizes of mesh through which the gravel is filtered. The top mesh spacing is about $\frac{1}{2}$ inch in size. The second mesh spacing is about $\frac{1}{4}$ inch in size. The third mesh spacing is about 3 millimeters in size. The mesh of each screen is made of nylon. The upper and lower portions of the frame are coupled together with screws. The screws used in construction are conventional in design and commercially available. Before being coupled together with screws, the annular rings are sealed together with clear silicone. The rocker is constructed using a plank about 1 inch thick, about 4 inches wide, and about 12 inches long. Generally cam-shaped rockers are used. Each rocker has holes of about $\frac{1}{4}$ inch in size drilled therethrough. Each rocker is then secured to each end of the plank with screws disposed through the holes. The preferred embodiment weighs less than five pounds.

More specifically, in the preferred embodiment, the first tier employs a $\frac{1}{2}$ inch galvanized steel mesh screen 34 connected by 6/32 by $1\frac{1}{2}$ inch long galvanized or stainless steel screws 54, lock washers and nuts. The handles 36 are to be made of $\frac{1}{4}$ by 1 inch galvanized flat stock. The two depending support legs 38 are spaced 180 degrees from each other. They are made either from $\frac{1}{4}$ by 1 inch galvanized flat stock or incorporated into the PVC plastic mold. The legs 38 and 28 are on the upper tier only, the first and second tiers.

The second tier preferably employs a $\frac{1}{4}$ inch galvanized steel mesh screen 42 connected together by 6/32 by $1\frac{1}{2}$ inch long galvanized or stainless steel screws 54, lock washers and nuts. The handle 44 is constructed like handle 36. The leg 28 is constructed like leg 38.

The third tier preferably employs a 3 millimeter nylon sun screen mesh 48 connected together by 6/32 by 2 inch long galvanized or stainless steel screws 54, lock washers and nuts. The 2 inch screws are used for the clearance of the bottom of the bucket for proper drainage.

The rings 20 and 22 are preferably $\frac{3}{8}$ inch thick, fabricated of polyvinyl chloride (PVC), preferably by injection system molds. They are cheaper, easier to mass produce and are virtually indestructible.

To operate the present invention, gravel is first shoveled into the top tiered screen and a separate bucket of water is used to wash away the silt. The bucket is gently rocked during this process. Any gold nuggets are then removed from the top screen. Non-gold bearing particulates are discarded. The first screen is then removed, and the washing and rocking is then repeated with the concentrates present on the second tiered screen. Tweezers and a snuffer bottle are used to pick out the smaller nuggets and flakes. Non-gold bearing particulates are discarded. The second screen is then removed. The fine sands are trapped in the nylon mesh of the third tier. They are collected to be processed later in a more leisurely and controlled environment.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letter Patent of the United States is as follows:

1. A rocker bucket gold recovery system for recovering gold from gold-bearing gravel comprising, in combination:

a bucket having a flat circular bottom, an upstanding tubular sidewall coupled to the periphery of the bottom, a curved handle coupled to the sidewall, and a plurality of radially extending holes disposed on the bottom for drainage;

a rocker constituting an elongated rigid plank with each of its ends formed in a cam-shaped configuration coupled to the bottom of the bucket for rocking the bucket back and forth when a jigging force is applied thereto; and an upper, an intermediate, and a lower classifying screen disposed within the bucket in a tiered configuration for effecting a separation of gold-bearing gravel poured into the bucket into portions composed of essentially equivalent sized particles, each classifying screen comprising an upper annular frame, a lower annular frame, and a mesh coupled therebetween, a handle coupled to the upper annular frame adapted for allowing the screen to be lifted by hand and adapted for supporting another screen disposed thereover, and a pair of diametrically opposed legs extending downwardly from the lower annular frame adapted for supporting the screen and defining a space therebetween adapted for holding separated portions of gravel collected by another screen disposed thereunder.

2. The rocker bucket gold recovery system as set forth in claim 1 wherein the upper classifying screen includes an upper $\frac{1}{2}$ inch galvanized steel mesh, the lower classifying screen includes an intermediate $\frac{1}{4}$ inch galvanized steel mesh and the lower classifying screen includes a lower 3 millimeter nylon sun screen mesh.

* * * * *